United States Patent [19]

Hakasaari

[11] Patent Number: 4,593,511

[45] Date of Patent: Jun. 10, 1986

[54] PANEL FOR EXTERIOR INSULATION

[75] Inventor: Tapio K. Hakasaari, Palokka, Finland

[73] Assignee: Oy Partek AB, Parainen, Finland

[21] Appl. No.: 615,789

[22] Filed: May 31, 1984

[30] Foreign Application Priority Data

Jun. 1, 1983 [FI] Finland ..... 831960

[51] Int. Cl.[4] ..... E04B 1/74

[52] U.S. Cl. ..... 52/404; 52/521; 52/539; 52/540; 52/782; 52/809

[58] Field of Search ..... 52/404, 478, 519, 520, 52/539, 540, 541, 593, 595, 782, 809, 521

[56] References Cited

U.S. PATENT DOCUMENTS

| | | | |
|---|---|---|---|
| 2,645,824 | 7/1953 | Titsworth | 52/303 |
| 2,823,426 | 2/1958 | Dunlap | 52/541 |
| 4,129,972 | 12/1978 | Sherman et al. | 52/303 |
| 4,164,832 | 8/1979 | Van Zandt | 52/785 X |
| 4,277,926 | 7/1981 | Sherman et al. | 52/404 X |
| 4,286,420 | 9/1981 | Pharmakidis | 52/404 |
| 4,388,361 | 6/1983 | Vassalli | 52/595 X |

FOREIGN PATENT DOCUMENTS

| | | | |
|---|---|---|---|
| 571421 | 3/1959 | Canada | 52/404 |
| 43232 | 2/1971 | Finland . | |
| 341983 | 12/1959 | Switzerland | 52/519 |

*Primary Examiner*—Alfred C. Perham
*Assistant Examiner*—Jean M. LaKemper
*Attorney, Agent, or Firm*—Dressler, Goldsmith, Shore, Sutker & Milnamow, Ltd.

[57] ABSTRACT

Pre-fabricated modular panels for attachment to the exterior walls of existing buildings to provide supplementary insulation. The panels include exterior facing, vertical support ribs, spacer members, a fastening strip secured to the spacer members and compressible insulation mounted from the vertical ribs to provide a ventilation space between the insulation and the facing. When the fastening strip is fastened to the building exterior wall, the insulation contacts said wall and is compressed thereagainst in contour accommodating relationship.

5 Claims, 6 Drawing Figures

PANEL FOR EXTERIOR INSULATION

BACKGROUND OF THE INVENTION

The present invention relates to exterior supplementary thermal insulation of a detached house, a row house, a small block of flats, or a similar building, and its object is to provide an insulation panel easily installed by a small team (two people).

The panels are self-supporting and do not require any rails or grips pre-installed on the fastening base; the fastening system is part of the panel itself.

The panels are suitable for both exterior supplementary insulation and for exterior cladding panels in new construction.

The structure is thermally considerably more economical than the currently used alternatives; the share of cold bridges is 0.6%.

From the viewpoint of, for example, humidity, and stresses and erosion caused by changes in temperature, it has been observed that exterior thermal insulation is a better alternative for a wall structure than interior insulation (Puurakentamista, tekniikkaa, arkkitehtuuria/Puuinformaatio ry 2/1982, pp. 39, 40, 41).

In addition, in exterior insulation the expensive transfer of radiators and electric wires is eliminated; the work does not disturb the residents.

In types of housing in which more than one household are involved, exterior insulation is often the only form of supplementary insulation.

There is an obvious need for supplementary insulation of walls, and the demand is on the increase.

Ar present, supplementary insulation of exterior walls is in practice carried out in such a way that the existing structure is stripped as far as the ventilation slot, then battening the height of which corresponds to the height of the thermal insulation is installed, the thermal insulation is installed, the windproofing material is fastened, the laths are nailed, the exterior cladding is fastened and painted. Another way to do the work is to use so-called windproofing wool together with nailing spacers, to nail the laths, and to fasten the exterior cladding (Lisäeristysvihko, Oy Partek Ab, Insulation Industry).

An exterior panel technique which works in practice has not existed in the field.

Finnish Pat. No. 43232 does not work in the Finnish conditions:

- the panel is not in contact with a warm surface, but in between there is a ventilated slot; for this reason the structure does not have great significance in terms of thermal economy
- if insulation is added into the slot, the required ventilation slot will be lacking.

The greatest disadvantages of present-day supplementary insulation practice are its many stages and the complicated work, the slowness of the work, uncertainty of a good final result, losses of material, full, expensive scaffolding, and the fact that it is troublesome for the builder.

In addition, it must be taken into consideration that, for these reasons, supplementary insulation, often extremely important, is not carried out.

SUMMARY OF THE INVENTION

The panel according to the invention provides a crucial improvement with regard to the disadvantages presented above, and also significant other advantages which cannot be achieved through on-site construction.

Compared with the present-day practice the invention provides, among other things, the following advantages:

1 the amount of cold bridges is only about 0.6%; thus cold bridges need not be taken into account in the calculations 2 the thermal insulation is installed in the panel in the horizontal position on the maufacturing table, and so the end result is not likely to have errors in workmanship 3 the panels are assembled in their entirety from the rear side, and so that side of the facing material which is subject to stresses remains unbroken 4 the panels can be applied to wooden facades, using different horizontal siding alternatives, different vertical siding alternatives, and provided with different kinds of facade boards; these alternatives can be combined in the same building 5 the panel is lightweight (weighs only about 10 $kg/m^2$)

6 the installation to the wall consists of only one work stage—the fastening. This enables installation to be carried out irrespective of the season 7 each panel is self-supporting; stresses are not multiplied from one panel to another 8 using the panels, a finished wall with cladding , ventilation slot and insulation pre-installed is obtained immediately 9 in panel joints and in extensions the thermal insulation continues unbroken over the wall 10 no great scaffolding costs; can be installed using a ladder 11 the product is suitable for industrial production.

The solutions for achieving the advantages are described below in greater detail; the principal characteristics are given in the accompanying claims.

DESCRIPTION OF THE PREFERRED EMBODIMENT

The panel to which the invention relates has a panel-fastening strip (1) which is a fixed part of the panel, the strip being made from, for example, plywood. The panel is fastened to the frame structure or to the load-bearing wall structure by nailing, staple-gunning or screwing through the fastening strip (1).

Figures 1, 1A, 1B, 1C, 1D:
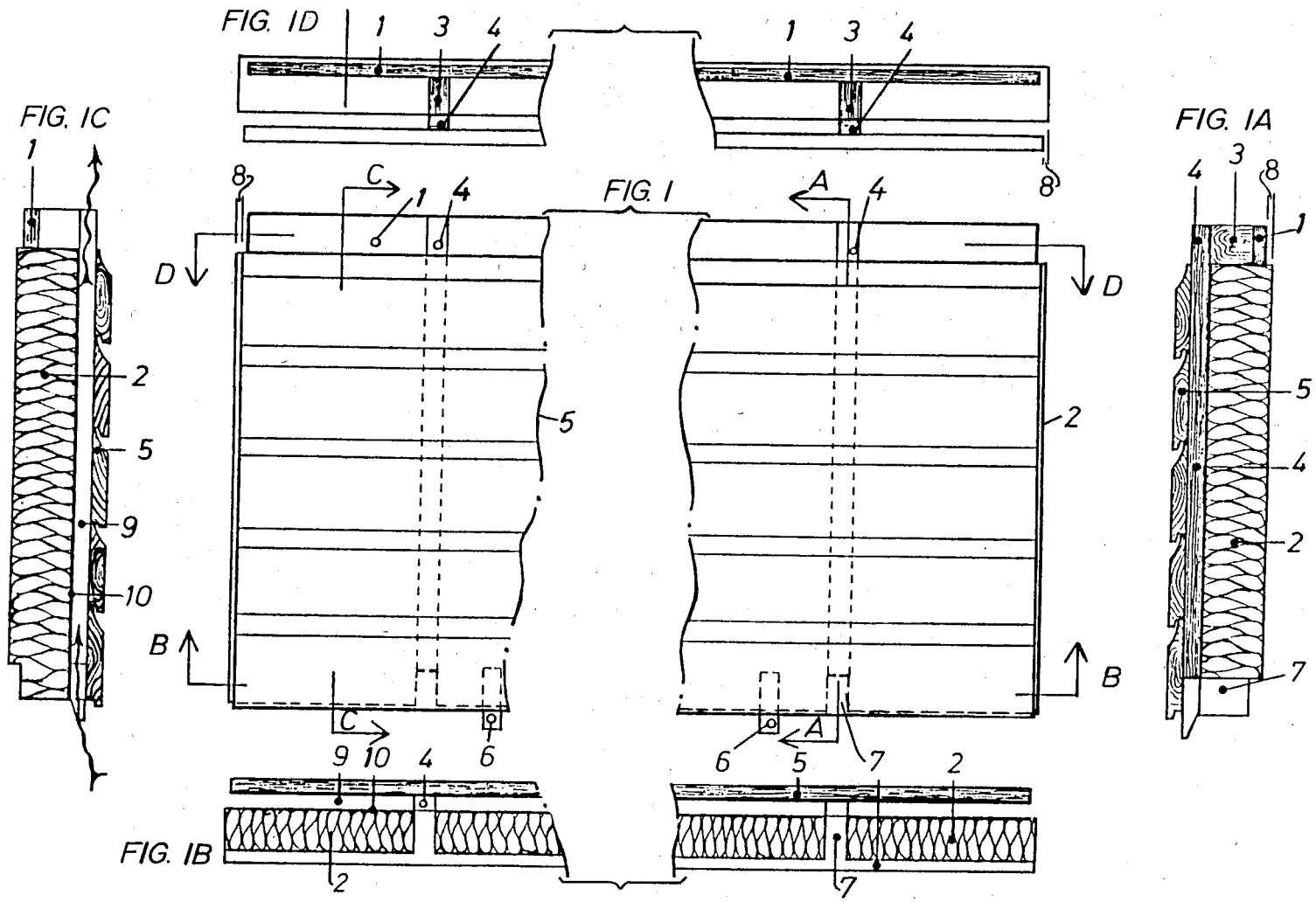
FIG. 1 is a broken elevational view of the panel.
FIGS. 1A, 1B, 1C, and 1D are sectional views on the planes of the lines indicated.
Figure 2:
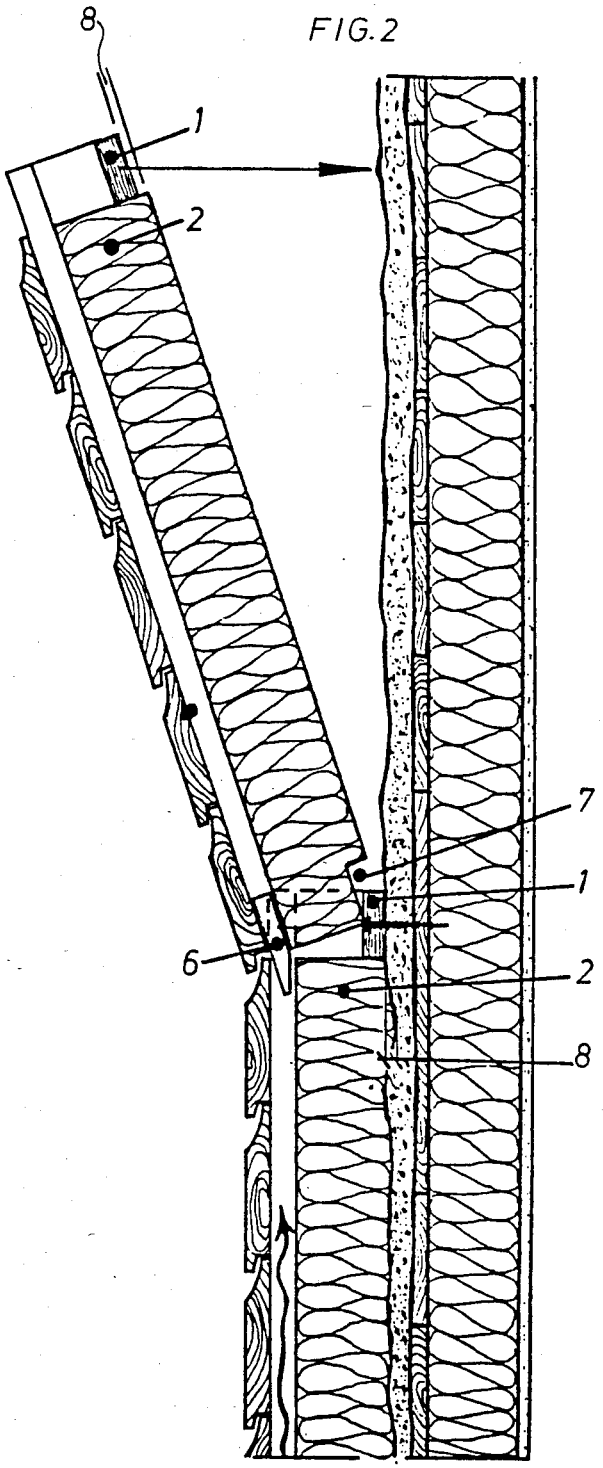
FIG. 2 is a vertical sectional view illustrating installation of the panels to a building exterior.

The fastening method, and the fastening point in the direction of the strip can be varied. The length by which the thermal insulation (8) extends beyond the fastening strip (1) is about 15 mm, and so the insulation takes the unevenness of the wall into account by compressing and settles tightly against the wall surface to be insulated (FIG. 2).

The fastening strip has means comprising elevations (3) which are in close adjoinment with the facing-material fastening strips (4) in the ventilation slot (9).

The panel is assembled on the manufacturing table "from the rear" in such a way that first the facing material (5) is placed on an area of the required dimensions, the facade downwards. Thereafter the facade-fastening strips or studs (4) with their elevations (3) are fastened to the facing material (5) with staples, nails or screws, depending on the material of the fastening strip (4) and on the facing material (5).

Thus, for example, in a wooden facade there is the advantage that the wearing surface remains unbroken.

Thereafter the panel-fastening strip (1) is fastened, and finally the thermal insulation (2).

The spaces (7) for the fastening strip (1) and the elevation (3), required in the installing, are cut in the thermal insulation.

Only the elevations (3) (surface area about $25 \times 50$ $mm^2$) penetrate the thermal insulation (2).

For detached houses the panels are manufactured in wall lengths.

The facing material can be wood in different vertical or horizontal siding alternatives, or a panel such as stone-clad plywood board; the loadbearing structure can be of, for example, plywood; the thermal insulation has windproofing (10); the insulation is resilient and porous, for example mineral wool.

INSTALLATION OF THE PANELS WHEN THE FACADE IS HORIZONTAL SIDING

The lowest panels are installed with precision in a horizontal position. The lowest panels have in their lower part a structure corresponding to the elevations (3) and the fastening strip (1), and the panel is fastened at only its upper and its lower part.

The next panel is lifted in an oblique position on top of the lowest panel (FIG. 2), at which time the protrusion (6) in the lower part of the panel goes behind the topmost siding board. Thereafter the panel is pushed against the wall and fastened to its base through the fastening strip (1). When the panel is pushed against the wall the joint between the panels is locked by means of the protrusion (6), and the thermal insulation (2) is pressed against the base (thermal insulation extension (8)).

This procedure is continued over the entire height of the wall. The same panel can also be installed vertically.

The panels do not require rails or grips pre-installed on their fastening base; the fastening system is part of the panel itself.

What is claimed is:

1. A pre-fabricated, modular insulating panel for cladding attachment to the exterior wall of an exterior building comprising:

exterior facing means having inner and outer surfaces and lateral edges;

a plurality of spaced facing means-fastening strips secured to the inner surface of said facing means;

elevation means secured to each of said facing means-fastening strips adjacent a top edge thereof and projecting inwardly therefrom;

an elongated panel-fastening strip secured to said elevation means and adapted to be fastened to the exterior wall of the building; and compressible insulation means mounted from and spanning said facing means-fastening strips and extending inwardly of said panel-fastening strip whereby said insulation means is compressed against the building exterior wall when said panel-fastening strip is fastened to said wall.

2. A panel according to claim 1 wherein said facing means-fastening strips comprise vertical studs, said insulation means being mounted from said inner surface of said studs whereby the thickness of said studs provides a ventilation slot between said insulation means and exterior facing means.

3. A panel according to claim 2 wherein a pair of said studs is secured to said exterior facing means, one each adjacent the lateral edges of said facing means, said insulation means projecting laterally outwardly of said exterior facing means whereby laterally adjacent panels connected to the building wall compress the insulation means along the lateral edges of the facing means to provide a thermally sealed vertical joint between said adjacent panels.

4. A panel according to claim 2 wherein bottom edges of said insulation means opposite from said elevation means comprises a plurality of recesses for receiving therein in contour accommodating relationship the studs and elevation means of the panel fastened to the buiding exterior wall immediately therebeneath.

5. A panel according to claim 4 comprising further locking means depending from the facing means for positioning and locking each said panel to the panel immediately therebeneath.

* * * * *